US009732951B2

(12) United States Patent
Guercio et al.

(10) Patent No.: US 9,732,951 B2
(45) Date of Patent: Aug. 15, 2017

(54) MODULAR LIGHT FIXTURE WITH ADJUSTABLE LIGHT DISTRIBUTION PATTERN

(71) Applicant: RAB Lighting Inc., Northvale, NJ (US)

(72) Inventors: Vincenzo Guercio, Wallkill, NY (US); Wengang Gao, Ningbo (CN); Dan Wang-Munson, Bergenfield, NJ (US)

(73) Assignee: RAB Lighting Inc., Northvale, NJ (US)

( * ) Notice: Subject to any disclaimer, the term of this patent is extended or adjusted under 35 U.S.C. 154(b) by 148 days.

(21) Appl. No.: 14/729,154

(22) Filed: Jun. 3, 2015

(65) Prior Publication Data

US 2015/0354794 A1 Dec. 10, 2015

Related U.S. Application Data

(60) Provisional application No. 62/007,650, filed on Jun. 4, 2014.

(51) Int. Cl.
*F21V 21/30* (2006.01)
*F21V 29/00* (2015.01)
(Continued)

(52) U.S. Cl.
CPC ..... *F21V 21/30* (2013.01); *F21S 2/005* (2013.01); *F21V 14/02* (2013.01); *F21V 23/008* (2013.01);
(Continued)

(58) Field of Classification Search
CPC ..... F21V 21/26; F21V 21/30; F21V 14/02; F21V 23/008; F21V 29/74; F21V 29/763;
(Continued)

(56) References Cited

U.S. PATENT DOCUMENTS 6,450,668 B1 * 9/2002 Kotloff ..... F21S 8/06 362/221
7,131,753 B1 * 11/2006 Edwards, Jr. ..... F21S 2/005 362/11
(Continued)

FOREIGN PATENT DOCUMENTS

CN 300760140 3/2008
CN 201582683 9/2010
(Continued)

OTHER PUBLICATIONS

Cooper Lighting; Streetworks Energy Solutions; Product Brochure for the Marquis LED Sign Light; Apr. 12, 2012.
(Continued)

*Primary Examiner* — Alan Cariaso
(74) *Attorney, Agent, or Firm* — SmithAmundsen LLC; Douglas G. Gallagher; Kevin C. Oschman

(57) ABSTRACT

A modular light fixture includes an elongate light fixture base having a longitudinal axis and a plurality of light fixture modules. Each light fixture module includes a housing having an open face, and a light emitting device positioned inside the housing. The modular light fixture also includes a light emitting device driver configured for driving the light emitting devices. The light fixture modules are independently mounted to the light fixture base and extend perpendicularly from opposing sides of the light fixture base with the open faces facing a common direction to produce an initial light distribution pattern. Each light fixture module has a housing adjustment feature for independently pivoting the light fixture module about a pivot axis parallel to the longitudinal axis to modify the initial light distribution pattern. The modular light fixture includes a planar configuration in which the light fixture module housings are oriented along a common plane.

20 Claims, 11 Drawing Sheets

(51) Int. Cl.

| | |
|---|---|
| ***F21V 14/02*** | (2006.01) |
| ***F21V 29/74*** | (2015.01) |
| ***F21S 2/00*** | (2016.01) |
| ***F21V 23/00*** | (2015.01) |
| *F21Y 105/16* | (2016.01) |
| *F21V 7/00* | (2006.01) |
| *F21V 29/76* | (2015.01) |
| *F21Y 105/10* | (2016.01) |
| *F21Y 115/10* | (2016.01) |

(52) U.S. Cl.
CPC ..... *F21V 29/745* (2015.01); *F21V 7/0083* (2013.01); *F21V 29/763* (2015.01); *F21Y 2105/10* (2016.08); *F21Y 2105/16* (2016.08); *F21Y 2115/10* (2016.08)

(58) Field of Classification Search
CPC ..... F21V 7/0083; F21V 29/745; F21S 2/005; F21Y 2105/14; F21Y 2105/16; F21Y 2105/10
See application file for complete search history.

(56) References Cited

U.S. PATENT DOCUMENTS

| | | | | |
|---|---|---|---|---|
| 7,431,482 | B1 * | 10/2008 | Morgan | F21S 2/005 362/249.07 |
| 7,588,355 | B1 * | 9/2009 | Liu | F21S 2/005 362/240 |
| 7,682,051 | B2 * | 3/2010 | Xiao | F21V 21/30 362/364 |
| 7,806,557 | B2 * | 10/2010 | Liu | F21S 2/005 362/227 |
| 8,337,058 | B2 * | 12/2012 | Gordin | F21V 21/116 362/263 |
| 8,393,341 | B2 | 3/2013 | Li | |
| 9,091,423 | B2 * | 7/2015 | Shen | F21S 8/086 |
| 9,316,384 | B2 * | 4/2016 | Mumma | F21L 14/00 |
| 2006/0146550 | A1 * | 7/2006 | Simpson | F21S 8/08 362/431 |
| 2011/0032696 | A1 * | 2/2011 | Kim | F21S 2/005 362/184 |
| 2011/0133670 | A1 | 6/2011 | Lee et al. | |
| 2012/0294016 | A1 | 11/2012 | Tran et al. | |

FOREIGN PATENT DOCUMENTS

| | | |
|---|---|---|
| DE | 202009003239 | 8/2009 |
| JP | 1333170 | 6/2008 |
| JP | 1264672 | 2/2009 |

OTHER PUBLICATIONS

Brand Lighting; WAC Lighting Low Voltage Track Heads; Dec. 12, 2013; www.brandlighting.com/wac_track_heads_low_voltage.htm.

Archi Expo; Round wall mounted halogen spotlight (adjustable) NOMAD Modular Lighting Instruments; Dec. 12, 2013; www.archiexpo.com/prod/modular-lighting-instruments/round-wall-mounted-halogen-spotlights-adjustable-3838-660486.html.

Intra Lighting; Retail Enjoy Profit. Save on Lighting.; Product guide; Slovenija; www.intra-lighting.com.

Designing with Light; Lightolier Product Guide; Fall River MA, 2005.

* cited by examiner

MODULAR LIGHT FIXTURE WITH ADJUSTABLE LIGHT DISTRIBUTION PATTERN

RELATION TO OTHER PATENT APPLICATION

This application claims priority to U.S. provisional patent application 62/007,650, filed Jun. 4, 2014, with the same title.

TECHNICAL FIELD

The present disclosure relates generally to light fixtures, and more particularly to the production of different light distribution patterns.

BACKGROUND

Light fixtures are provided for a wide variety of applications, including both interior and exterior applications. Even among interior and exterior uses, there are a variety of different lighting requirements, depending on where the light fixture will be installed and the intended use. Thus, light fixtures are designed and manufactured with specific purposes in mind, including providing security, safety, and/or aesthetics. As should be appreciated, there are high costs associated with producing a variety of unique light fixtures, each specifically customized for a specific use and to provide a specific, predetermined lighting effect.

There is a continuing need to reduce manufacturing costs, and improve efficiency and effectiveness of both the manufacturing process and the resulting products. The incorporation, or use, of LEDs in both interior and exterior light fixtures is one example of the growing trend to improve efficiency. In particular, LEDs consume less energy and last longer than traditional fluorescent and incandescent light sources. Additional means for improving efficiency and effectiveness in the lighting industry are also needed. The present disclosure is directed to such an effort.

SUMMARY OF THE DISCLOSURE

In one aspect, a modular light fixture includes an elongate light fixture base having a longitudinal axis and a plurality of light fixture modules. Each of the light fixture modules includes a housing having an open face, and a light emitting device positioned inside the housing. The modular light fixture also includes a light emitting device driver configured for driving the light emitting device of each light fixture module. The light fixture modules are independently mounted to the elongate light fixture base and extend perpendicularly from opposing sides of the elongate light fixture base with the open faces facing a common direction to produce an initial light distribution pattern. Each of the light fixture modules has a housing adjustment feature for independently pivoting the respective light fixture module about a pivot axis parallel to the longitudinal axis to modify the initial light distribution pattern. The modular light fixture includes a planar configuration in which the housings of the light fixture modules are oriented along a common plane.

In another aspect, a modular light fixture system includes an elongate light fixture base selected from a plurality of light fixture bases. Each of the plurality of light fixture bases houses a light emitting device driver and has a different length to support one or more pairs of light fixture modules. The one or more pairs of light fixture modules are selected from a plurality of interchangeable light fixture modules.

Each of the interchangeable light fixture modules includes a housing having an open face and a light emitting device positioned inside the housing. In an assembled configuration, each module of the one or more pairs of light fixture modules is independently mounted to the elongate light fixture base using a housing adjustment feature, wherein the housing adjustment feature permits pivotable movement of the module relative to the elongate light fixture base.

DETAILED DESCRIPTION

Figure 1:
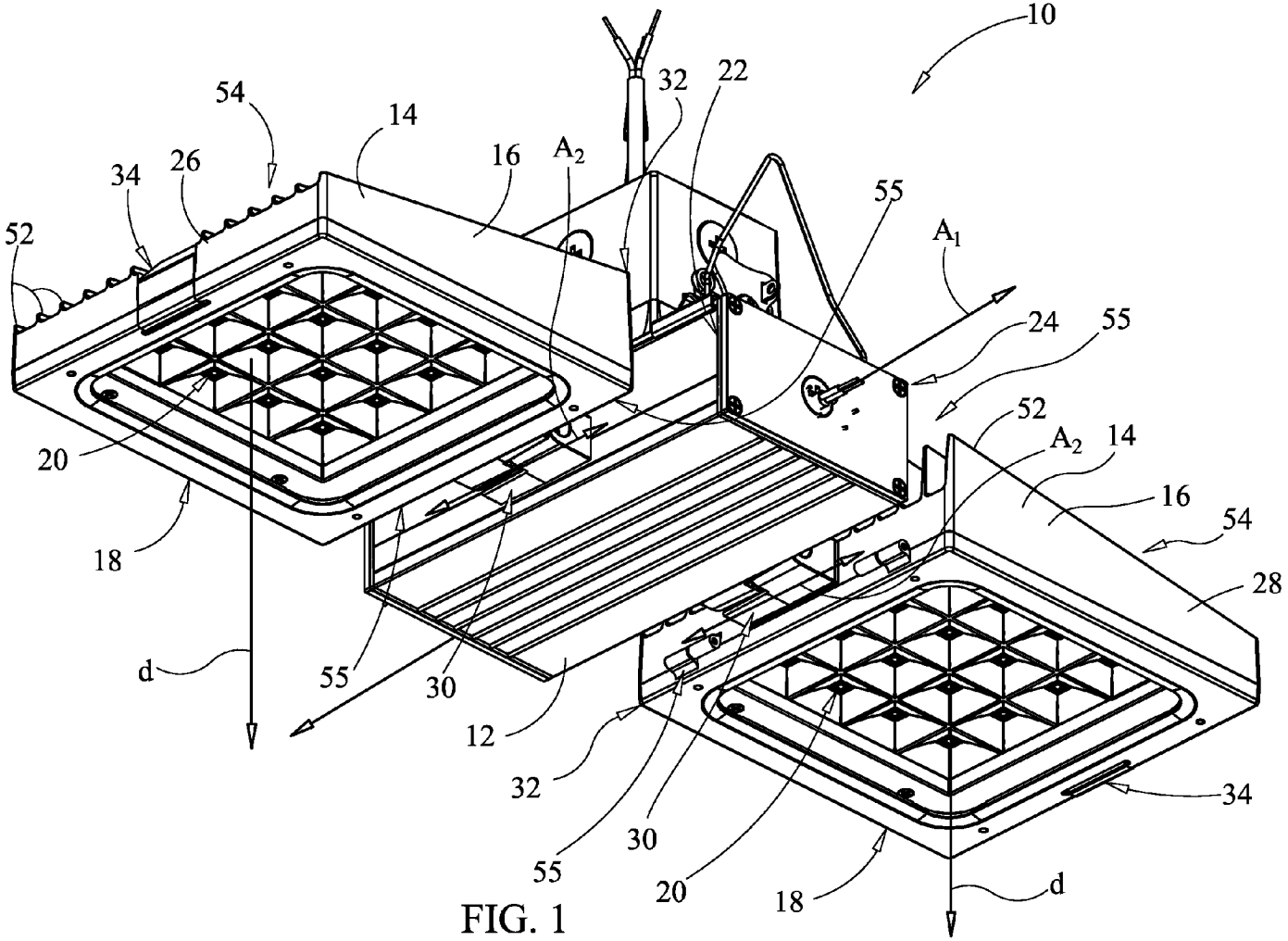
FIG. 1 is a bottom perspective view of a first exemplary modular light fixture, according to the present disclosure, shown in a planar configuration.
Figure 2:
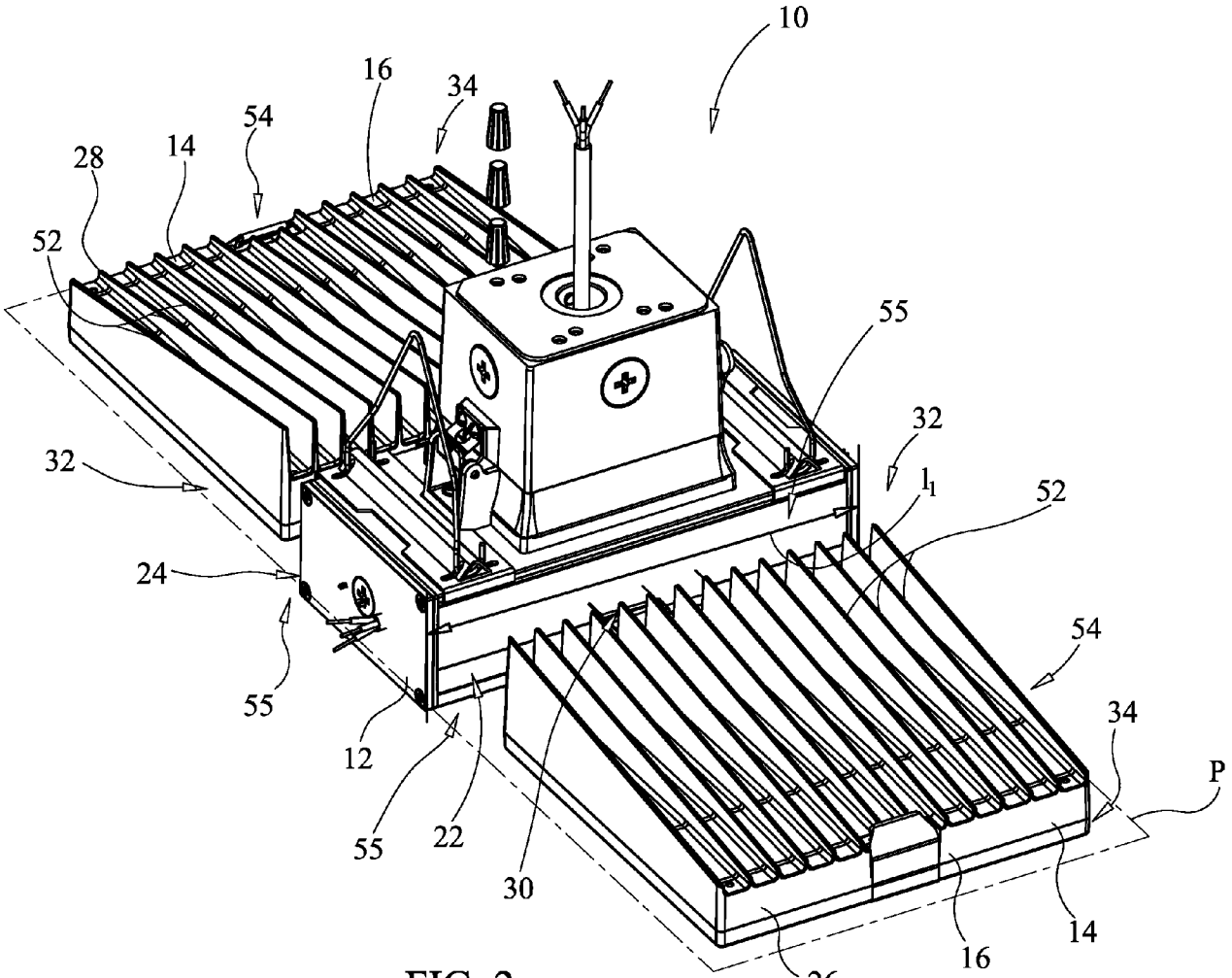
FIG. 2 is a top perspective view of the modular light fixture of FIG. 1, shown in the planar configuration.

Referring to FIGS. 1 and 2, a first exemplary embodiment of a modular light fixture according to the present disclosure is shown at 10. The modular light fixture 10 may generally include an elongate light fixture base 12 having a longitudinal axis $A_1$, and a plurality of light fixture modules 14 attached to or supported by the light fixture base 12. Each of the light fixture modules 14 may be similar, and may include a housing 16 having an open face 18 and at least one light emitting device 20 positioned inside the housing 16. For example, the one or more light emitting devices 20 may be light emitting diodes (LEDs). However, alternative light sources or light producing devices, including conventional light sources, may also be used with the modular light fixture 10.

The light fixture modules 14 may be independently mounted to the elongate light fixture base 12 and may extend perpendicularly from opposing sides 22 and 24 of the elongate light fixture base 12 with the open faces 18 facing a common direction d. According to an exemplary mounting arrangement for the modular light fixture 10, the light fixture base 12 and the light fixture modules 14 may have horizontal orientations and the common direction d may correspond to a downward direction, such as toward the ground or the floor. The light fixture base 12 may have a first fixed length $l_1$ sized to support a first light fixture module 26 and a second light fixture module 28. Together, the first and second light fixture modules 26 and 28 may define a first pair of light fixture modules 14. The first and second light fixture modules 26 and 28 may be positioned on opposite sides 22 and 24 of the light fixture base 12 at a common axial position along the longitudinal axis $A_1$, as shown. The dimensions of the light fixture base 12, as well as the number of light fixture modules 14, may vary, as will be described in greater detail below.

Each of the light fixture modules 14 may have its own housing adjustment feature 30 for independently pivoting the respective light fixture module 14 about a respective pivot axis $A_2$, which may be substantially parallel to the longitudinal axis $A_1$. An attached, or inner, end 32 of each light fixture module 14, or housing 16, may be mounted to the light fixture base 12 at the housing adjustment feature 30, with a free, or outer, end 34, which is opposite the attached end 32, being rotatable, or pivotable, about the respective pivot axis $A_2$. The modular light fixture 14 may have any number of different configurations, including a planar configuration, shown in FIGS. 1 and 2, in which the housings 16 of the light fixture modules 14 are oriented along a common plane P. According to the exemplary embodiment, the common plane P may be substantially horizontal.

Figure 3:
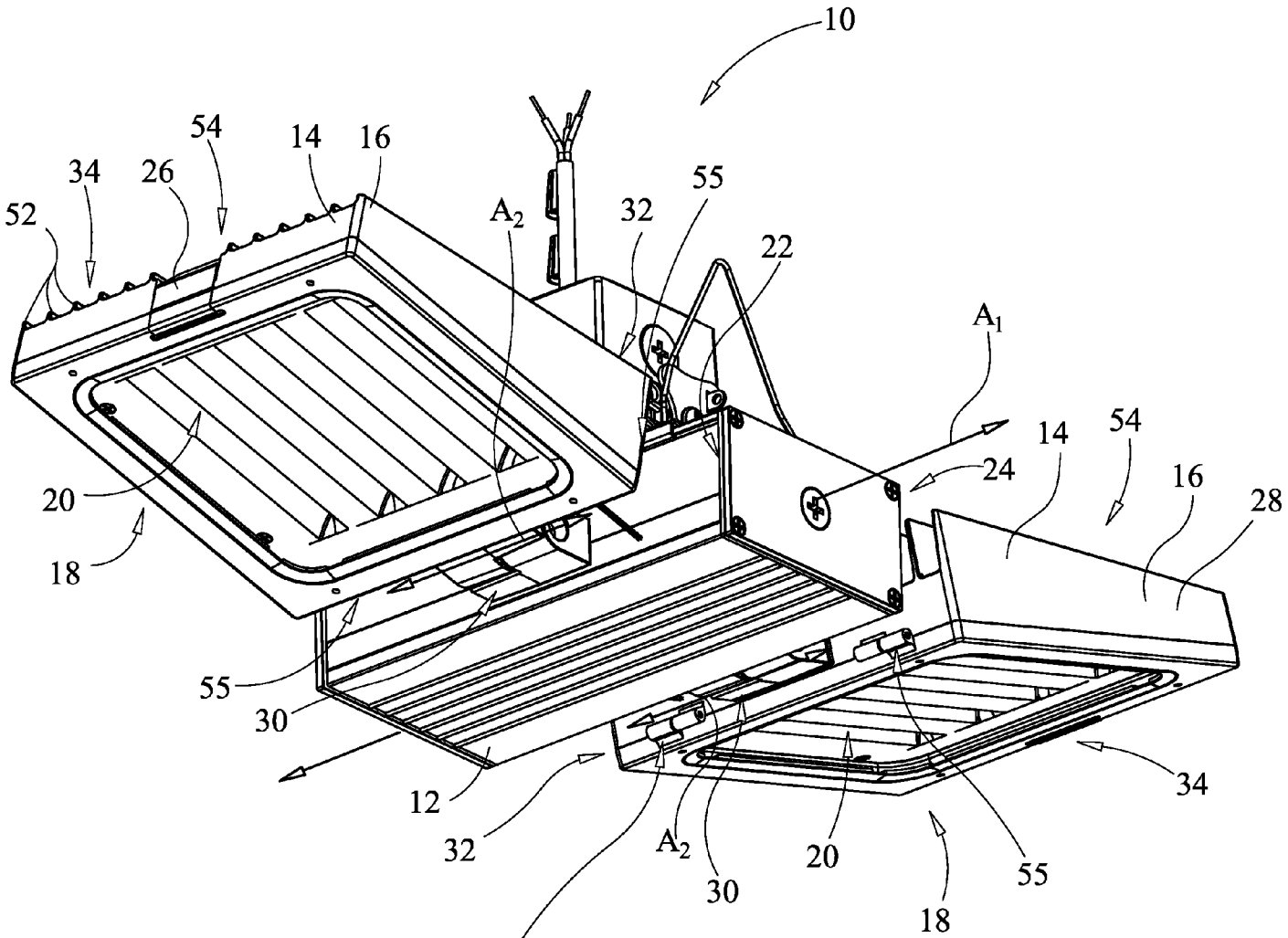
FIG. 3 is a bottom perspective view of the modular light fixture of FIG. 1, shown in a first adjusted configuration.
Figure 4:
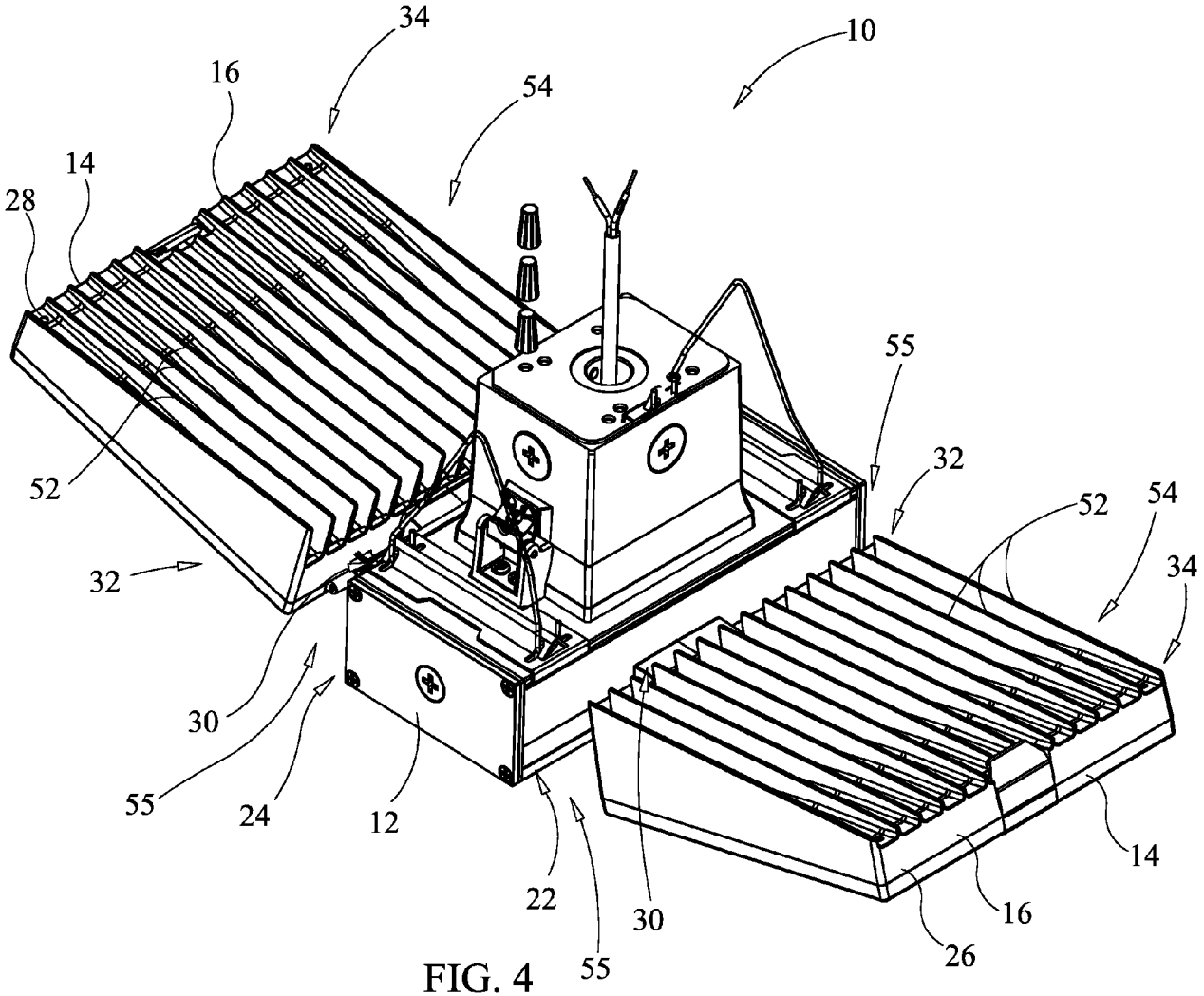
FIG. 4 is a top perspective view of the modular light fixture of FIG. 1, shown in the first adjusted configuration.

Turning now to FIGS. 3 and 4, the modular light fixture 10 may also have a first adjusted configuration, as shown, in which the free end 34 of each light fixture module 14 is pivoted upward, using the housing adjustment feature 30, to modify a light distribution of the modular light fixture 10, as will be discussed further below. Depending on the particular application, each light fixture module 14 may be pivotable in one or both directions about the pivot axis $A_2$ from the planar configuration of FIGS. 1 and 2. For example, the free end 34 of each light fixture module 14 may be pivoted upward and/or downward from its position shown in FIGS. 1 and 2. Further, the free ends 34 may be pivoted in a common direction or in different directions.

Figure 5:
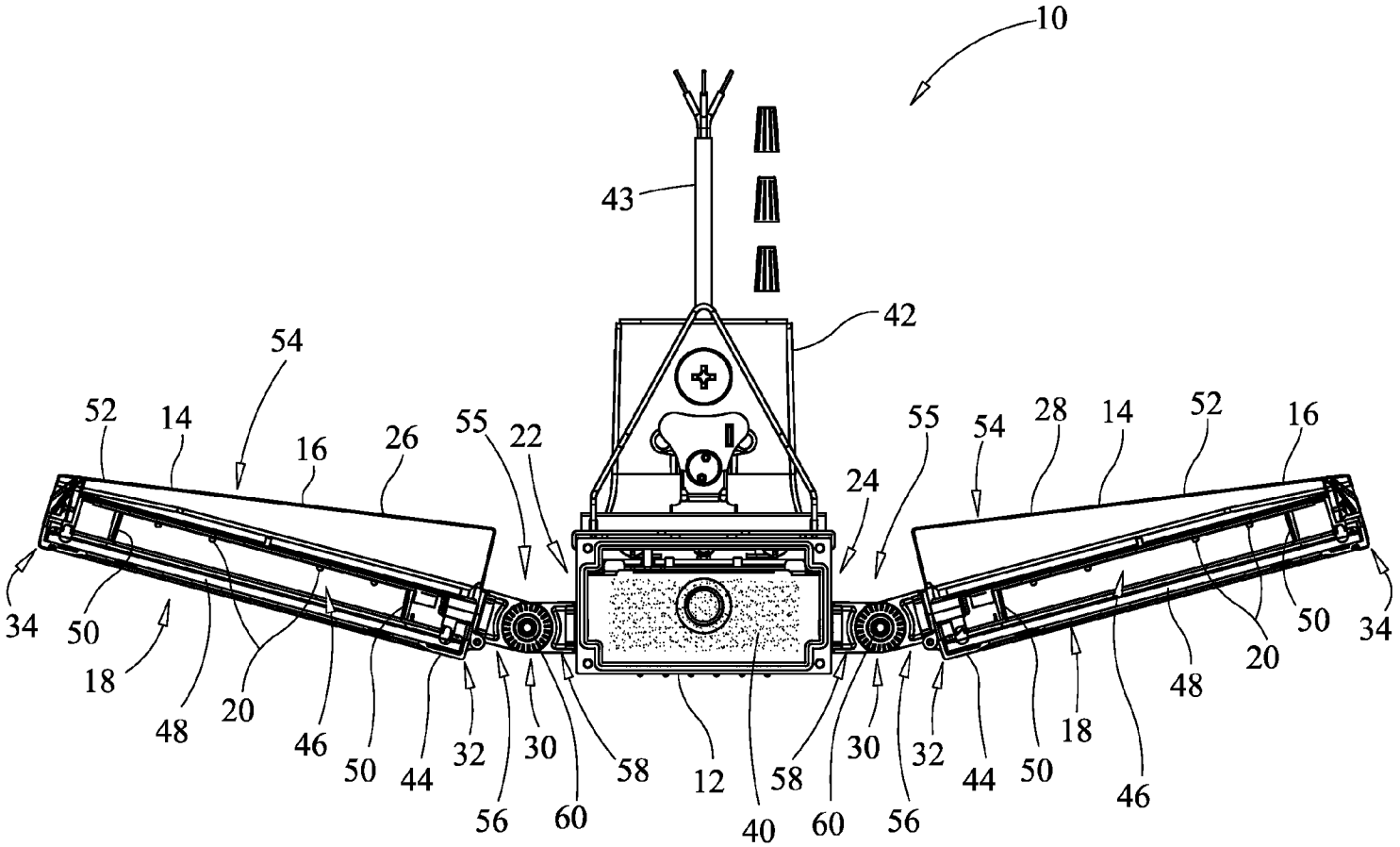
FIG. 5 is a cross-sectional view of the modular light fixture of FIG. 1, shown in the first adjusted configuration.

The components of the first exemplary modular light fixture 10 are discussed in greater detail with reference to FIG. 5. Including the components already introduced, the modular light fixture 10 may also include a light emitting device driver 40 configured for driving the one or more light emitting devices 20 of each light fixture module 14. For example, the light emitting device driver 40 may be an LED driver configured for driving one or more LEDs in a known manner. The light emitting device driver 40 may be housed within the light fixture base 12, as shown, and may be configured to drive any number, including all, of the light fixture modules 14 included in the modular light fixture 10. In addition, an electrical junction box 42, which includes, supports, or joins electrical wires 43, may be supported on the light fixture base 12. The modular light fixture 10 may be attached or mounted to a ceiling, or other support structure, using any known attachment or mounting means.

Each of the light fixture modules 14 may be substantially similar, and may generally include the housing 16 supporting the one or more light emitting devices 20, and additional components or features common in lighting fixtures. For example, and according to the exemplary embodiment, each light fixture module 14 may also include a door 44, such as a hinged door, for protecting and accessing an interior portion 46 of the housing 16. A lens 48, or another transparent or translucent component made from any of a variety of materials, such as plastic or glass, may be supported by and movable with the door 44. One or more reflectors 50 may be positioned within the housing 16 for directing light produced by the one or more light emitting devices 20 through the lens 48. According to some embodiments, the one or more light emitting devices 20 may be independent emitters arranged in a planar array. However, alternative numbers and arrangements of light emitting devices 20 are also contemplated.

Referring additionally to FIGS. 1-4, each light fixture module 14 may also include a plurality of cooling fins 52. The cooling fins 52 may be positioned on, or may be integral with, a back side 54 of the housing 16 opposite the open face 18, and may function to transfer and dissipate excess heat that may be generated by the light emitting devices 20. The cooling fins 52 may vary in number, size, orientation, and configuration to provide a desired cooling effect. As shown, the cooling fins 52 may span an entirety of the back side 54 of the housing 16. According to some embodiments, however, the cooling fins 52 may not be required. Additionally, or alternatively, the modular light fixture 10 may include one or more cooling channels 55 positioned between the attached end 32 of each light fixture module 14 and the elongate light fixture base 12 on either side, or both sides, of the housing adjustment feature 30. That is, the housing adjustment feature 30 may span only partially across the attached end 32 to define cooling channels between the light fixture module 14 and the elongate light fixture base 12.

Each housing adjustment feature 30 may interconnect a respective light fixture module 14 with the light fixture base 12, and may facilitate the movement, or adjustment, described herein. According to the exemplary embodiment, each housing adjustment feature 30 may be, or may include, a swivel mount. For example, a first portion 56 of the housing adjustment feature 30 may attach to or may be integral with the housing 16, while a second portion 58 of the housing adjustment feature 30 may attach to or may be integral with the light fixture base 12. The first and second portions 56 and 58 may be attached or joined by a fastening device 60, or other component, which may define a pivot location of the housing 16 relative to the light fixture base 12. Together, the first portion 56, the second portion 58, and the fastening device 60 may permit the movement described herein and may include appropriate additional and/or alternative components for permitting, restricting, and/or fixing particular movements. For example, each housing adjustment feature 30 may incorporate or use stop members to limit the range of motion of the respective light fixture module 14.

Materials selected for the components described herein may vary, depending on particular applications. For example, each of the light fixture base 12, the housings 16, and the housing adjustment features 30 may be made from any of a number of materials known to those skilled in the art. According to an exemplary embodiment, one or more of the light fixture base 12, the housings 16, and the housing adjustment features 30 may be made from a die cast aluminum or an aluminum alloy.

Figure 7:
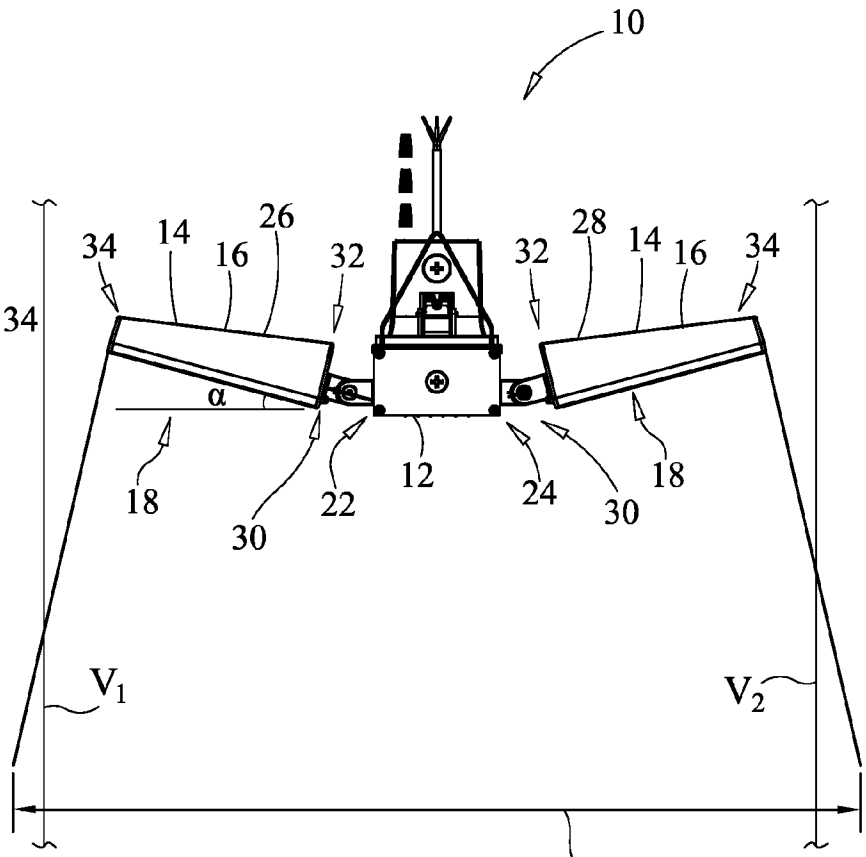
FIG. 7 is a side view of the modular light fixture of FIG. 1, shown in the first adjusted configuration.
Figure 6:
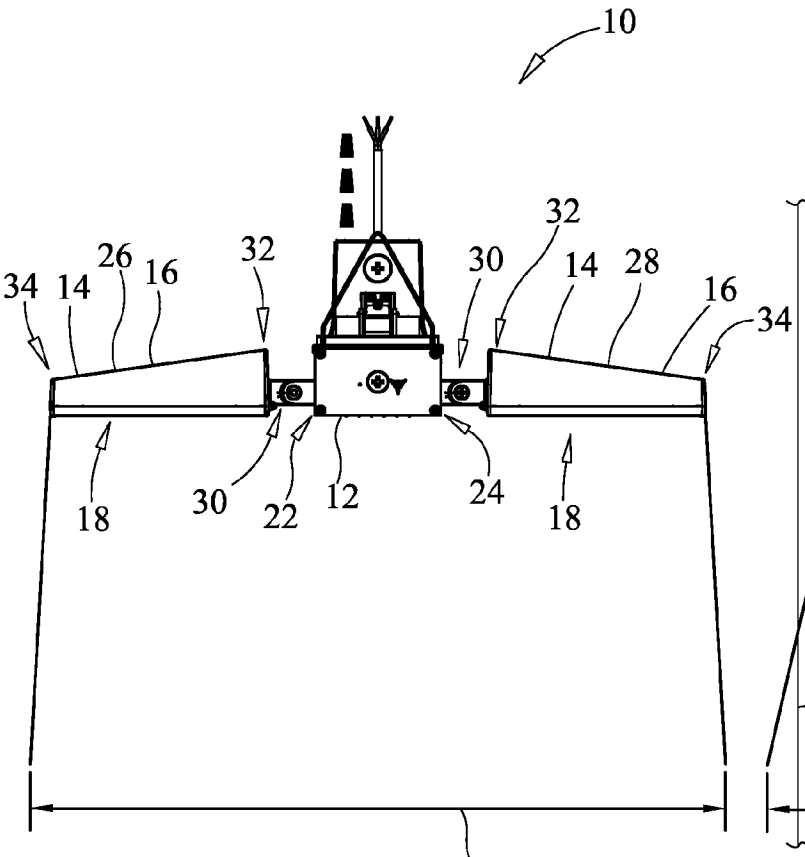
FIG. 6 is a side view of the modular light fixture of FIG. 1, shown in the planar configuration.

In the planar configuration, which was described with reference to FIGS. 1 and 2, the modular light fixture 10 may produce an initial light distribution pattern, as shown in FIG. 6. According to the initial light distribution pattern, the modular light fixture 10 may produce a lateral distribution of light on a lighted surface having a first width $w_1$. As described herein, the free end 34 of each light fixture module 14 may be pivoted upward using the housing adjustment feature 30 and may assume a first adjusted configuration to produce an adjusted light distribution pattern having a second width $w_2$, as shown in FIG. 7. As shown, the second width $w_2$ may be wider than the first width $w_1$.

Further, according to some embodiments, the modular light fixture 10 may be used as an "aisle lighter," positioned and configured to not only light a horizontal surface, such as a floor, but also to light vertical surfaces, such as aisles in a warehouse, for example. As such, the light fixture modules 14 may be pivoted to provide the appropriate distribution of light along vertical surfaces, such as, for example, vertical planes $V_1$ and $V_2$ of FIG. 7.

Each housing adjustment feature 30 may be configured to permit the movement described herein and also fix, or maintain, a selected adjustment of the light fixture module 14. Although not necessary, each of the housing adjustment features 30 may limit the angular range of motion of the free end 34 to less than about 20 degrees, as shown at angle a. Further, the free end 34 may be infinitely adjustable through the designated angular range of motion. That is, any desired adjustment of the light fixture modules 14 that is permitted by the housing adjustment features 30 may be selected, resulting in a desired light distribution pattern. In addition, because the light fixture modules 14 may be adjusted independently, the selected adjustment of one of the light fixture modules 14 may vary from that of another of the light fixture modules 14.

Figure 8:
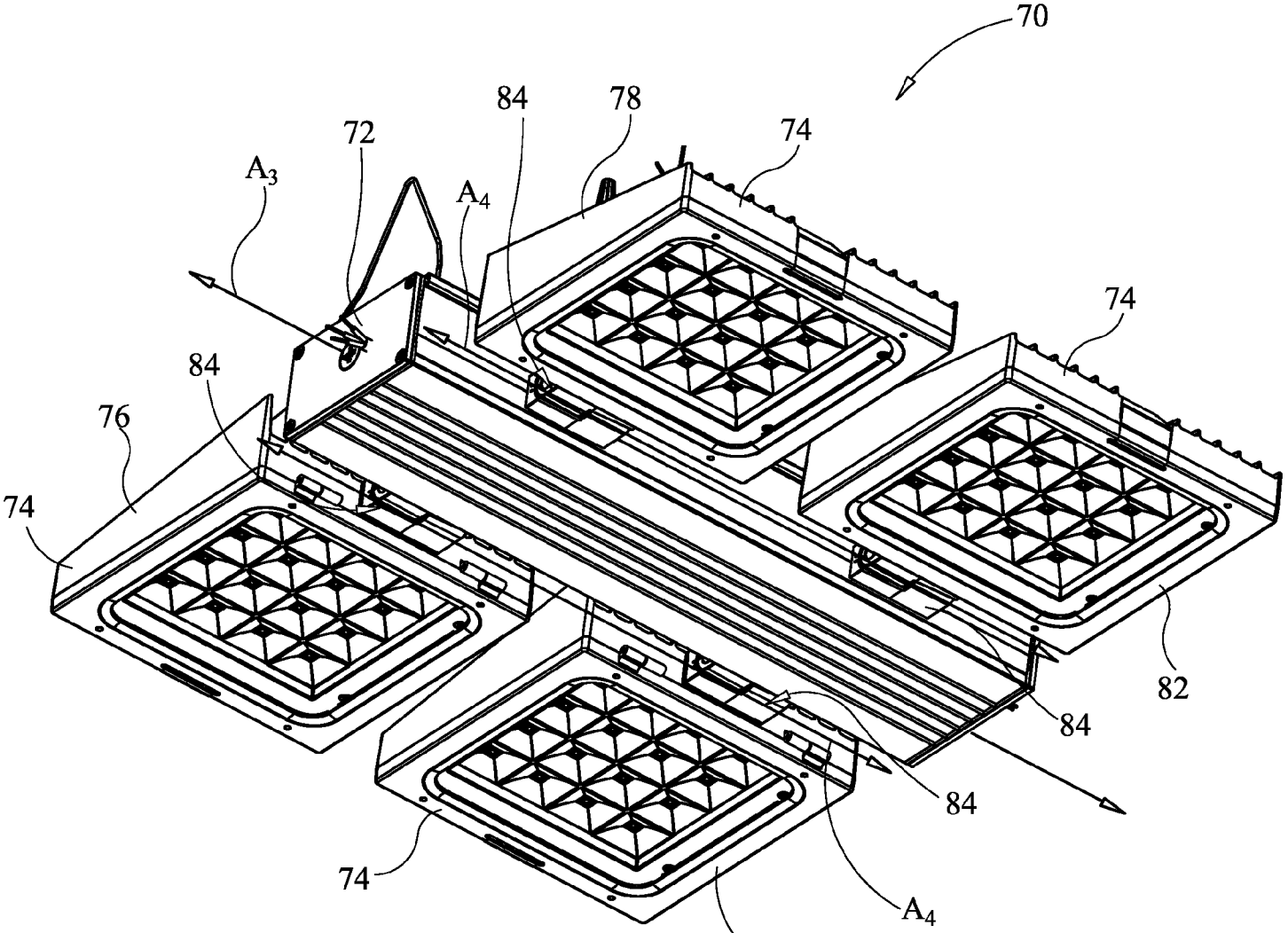
FIG. 8 is a bottom perspective view of a second exemplary modular light fixture, according to the present disclosure, shown in a planar configuration.
Figure 9:
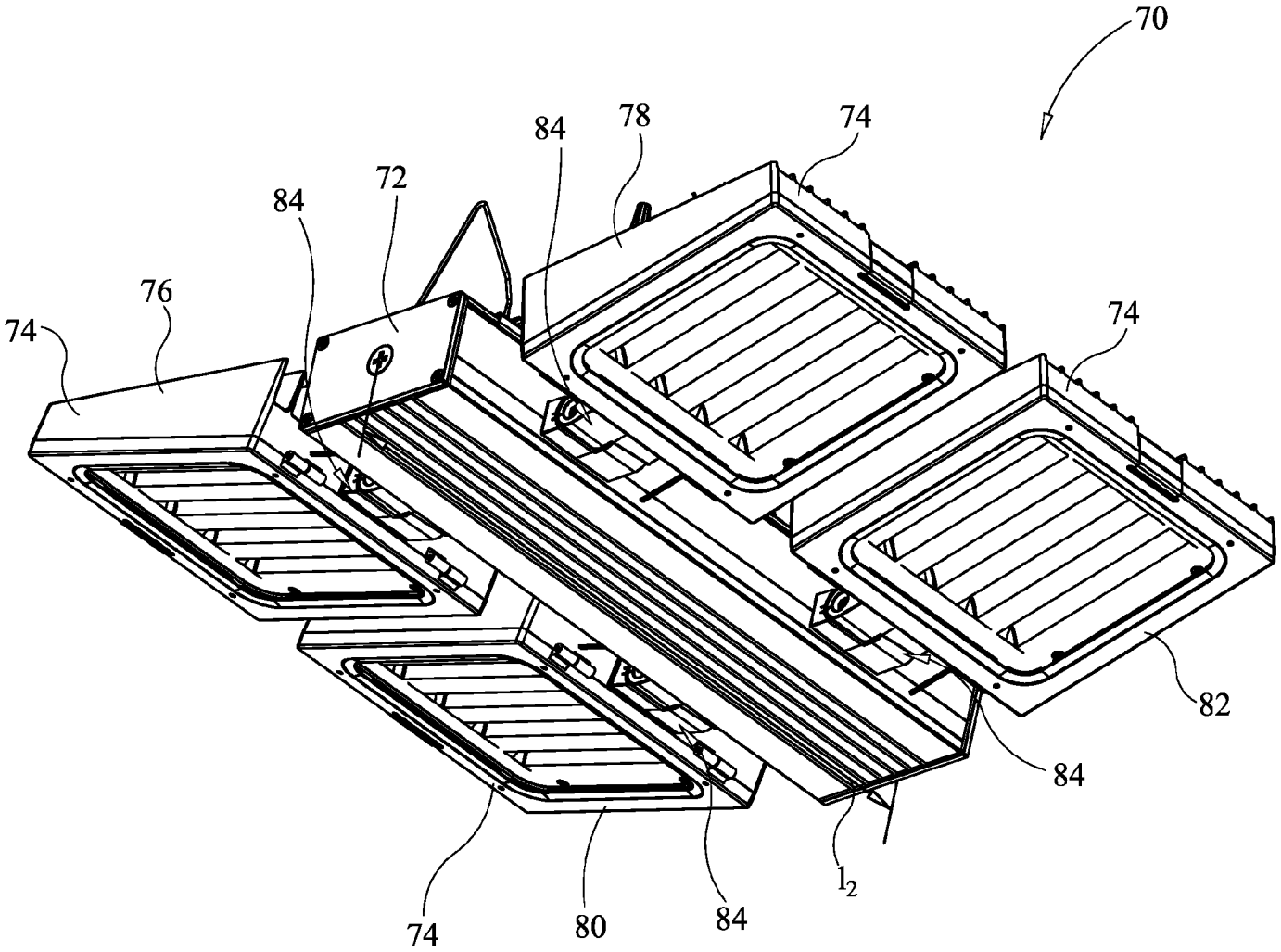
FIG. 9 is a bottom perspective view of the second exemplary modular light fixture of FIG. 8, shown in a first adjusted configuration.

A second exemplary embodiment of a modular light fixture according to the present disclosure is shown at 70 in FIGS. 8 and 9. The modular light fixture 70 may be similar to the modular light fixture 10 discussed above; however, a light fixture base 72 of the modular light fixture 70 may have a second fixed length $l_2$ greater than length $l_1$ and sized to support four light fixture modules 74. That is, the modular light fixture 70 may include a first light fixture module 76 and a second light fixture module 78, defining a first pair of light fixture modules 74, and also may include a third light fixture module 80 and a fourth light fixture module 82, defining a second pair of light fixture modules 74. The light fixture modules 74 in each of the first and second pairs may be positioned on opposite sides of the light fixture base 72 at a common axial position along a longitudinal axis $A_3$ of the light fixture base 72, as shown.

The modular light fixture 70 may also have a planar configuration, shown in FIG. 8, and at least one adjusted configuration, shown in FIG. 9. The light fixture modules 74 may be adjusted relative to the light fixture base 72 using housing adjustment features 84, which may function similarly to the housing adjustment features 30 described above. That is, each modular light fixture 70 may pivot about an axis $A_4$ defined by the housing adjustment feature 84. The adjusted configuration may be capable of producing a light distribution pattern having a width that is greater than a width of a light distribution pattern produced by the planar configuration, as described above. In addition, however, the light distribution pattern may have a length that is greater than a length of the light distribution pattern provided by the modular light fixture 10 discussed above.

Figure 10:
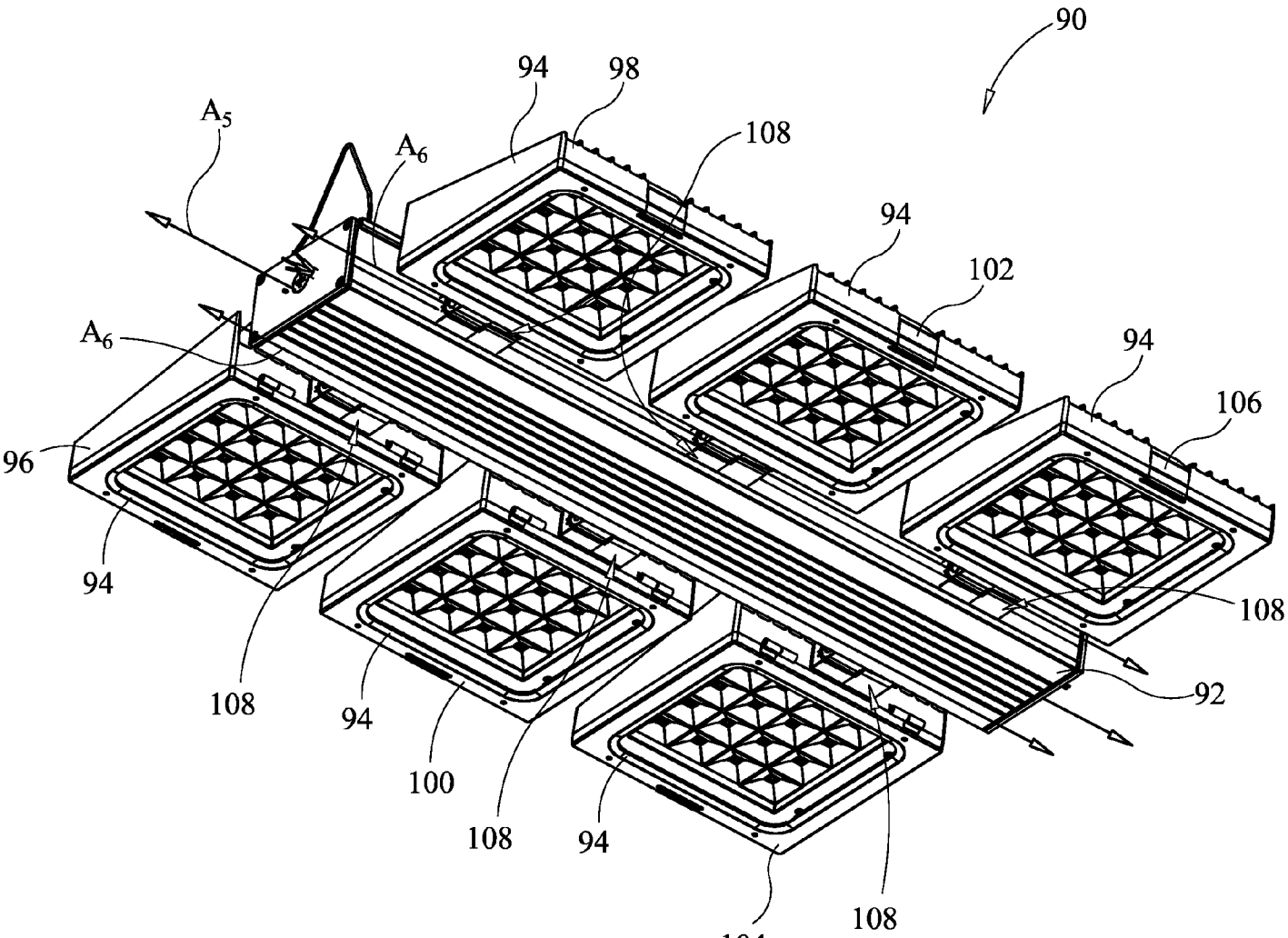
FIG. 10 is a bottom perspective view of a third exemplary modular light fixture, according to the present disclosure, shown in a planar configuration.
Figure 11:
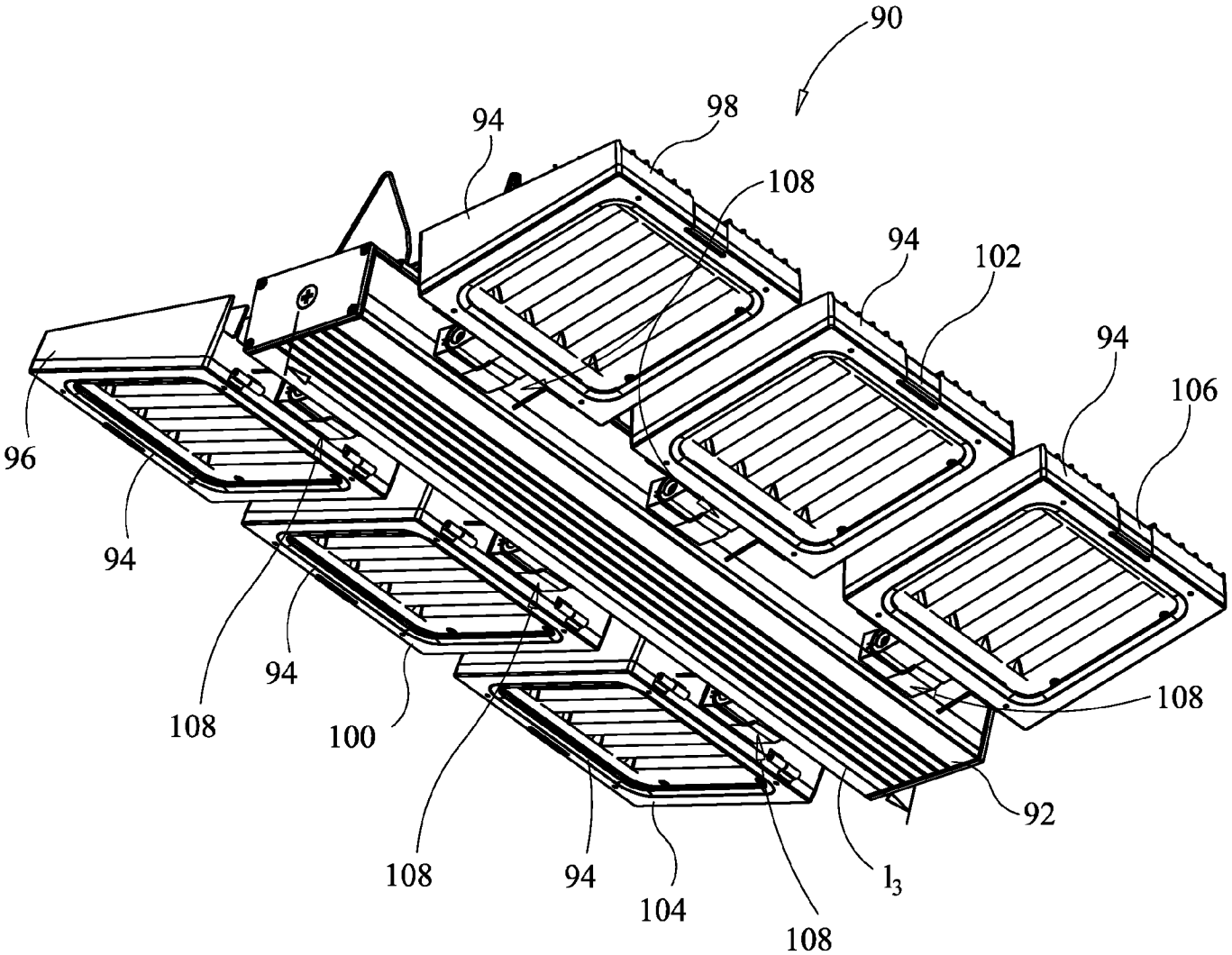
FIG. 11 is a bottom perspective view of the third exemplary modular light fixture of FIG. 10, shown in a first adjusted configuration.

Turning now to FIGS. 10 and 11, a third exemplary embodiment of a modular light fixture according to the present disclosure is shown at 90. The modular light fixture 90 may be similar to both the first exemplary modular light fixture 10 of FIGS. 1-7 and the second exemplary modular light fixture 70 of FIGS. 8 and 9; however, a light fixture base 92 of the modular light fixture 90 may have a third fixed length $l_3$ greater than lengths $l_1$ and $l_2$ of respective light fixture bases 12 and 72, and sized to support six light fixture modules 94. That is, the modular light fixture 90 may include a first light fixture module 96 and a second light fixture module 98 defining a first pair of light fixture modules 94, a third light fixture module 100 and a fourth light fixture module 102 defining a second pair of light fixture modules 94, and also a fifth light fixture module 104 and a sixth light fixture module 106 defining a third pair of light fixture modules 94. The light fixture modules 94 in each of the first, second, and third pairs may be positioned on opposite sides of the light fixture base 92 at a common axial position along a longitudinal axis $A_5$ of the light fixture base 92, as shown.

The modular light fixture 90 may also have a planar configuration, shown in FIG. 10, and at least one adjusted configuration, shown in FIG. 11. The light fixture modules 94 may be adjusted relative to the light fixture base 92 using housing adjustment features 108, which may function similarly to the housing adjustment features 30 and 84 described above. That is, each modular light fixture 90 may pivot about an axis $A_6$ defined by the housing adjustment feature 108. The adjusted configuration may be capable of producing a light distribution pattern having a width that is greater than a width of a light distribution pattern produced by the planar configuration, as described above. In addition, however, the light distribution pattern may have a length that is greater than the light distribution pattern lengths provided by the light fixture modules 10 and 70.

Figure 13:
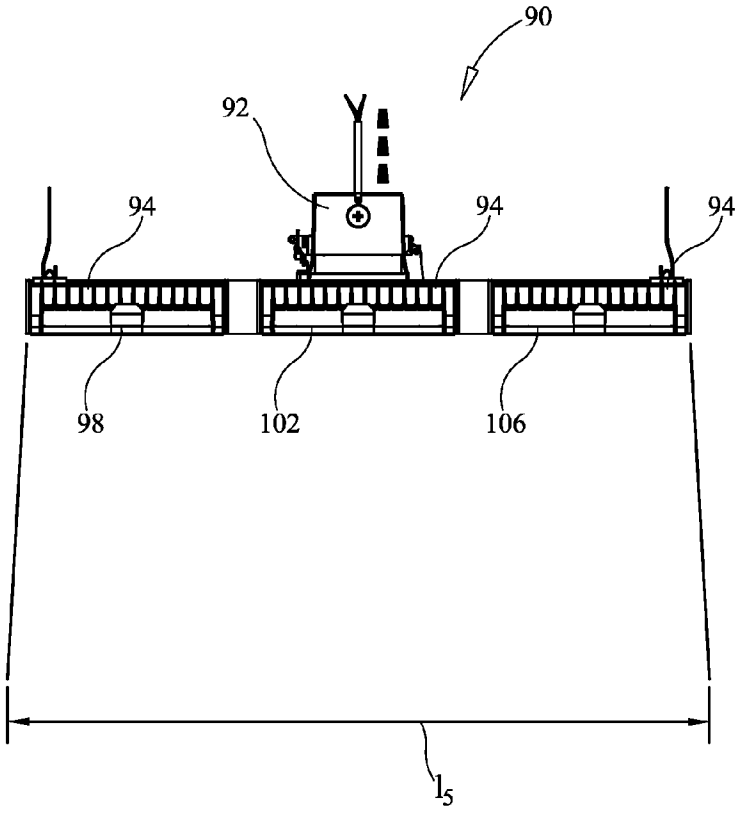
FIG. 13 is a side view of the modular light fixture of FIG. 10, shown in a planar configuration.
Figure 12:
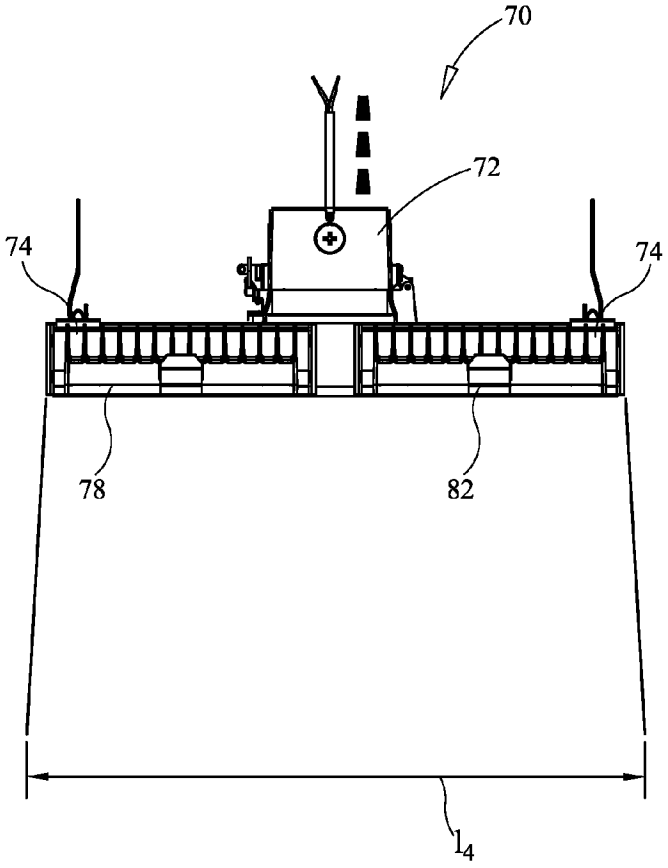
FIG. 12 is a side view of the modular light fixture of FIG. 8, shown in a planar configuration.

With particular reference to FIGS. 12 and 13, it is shown that the light distribution length may vary depending on a particular application and/or configuration. That is, the modular light fixture 70 of FIGS. 8 and 9, having two pairs of light fixture modules 74, may produce a light distribution pattern having a shorter length $l_4$ than a length $l_5$ of a light distribution pattern of the modular light fixture 90 of FIGS. 10 and 11, having three pair of light fixture modules 94. As should be appreciated, these light distribution pattern lengths $l_4$ and $l_5$ may both be longer, or greater, than a light distribution pattern length produced by the modular light fixture 10 of FIGS. 1-7, which has one pair of light fixture modules 14.

The modular light fixture, or modular light fixture system, of the present disclosure may be configured to include any number, such as an even number, of light fixture modules. The light fixture modules may be similar, such that they may be interchangeable. Manufacturing of modular light fixtures having varying light distribution pattern lengths may, thus, be improved. In addition, the light fixture modules of the modular light fixture are adjustable relative to the light fixture base to modify the width of the light distribution pattern. Further, each of the light fixture modules is independently adjustable to provide a highly customized light distribution pattern.

It should be understood that the above description is intended for illustrative purposes only, and is not intended to limit the scope of the present disclosure in any way. Thus, those skilled in the art will appreciate that other aspects of the disclosure can be obtained from a study of the drawings, the disclosure and the appended claims.

What is claimed is:

1. A modular light fixture, comprising:

an elongate light fixture base having a longitudinal axis;

a plurality of light fixture modules;

each of the light fixture modules having:

a housing having an open face;

a light emitting device positioned inside the housing; and a plurality of cooling fins extending from a side of the housing opposite the open face and defining a cooling fin height; and a light emitting device driver configured for driving the light emitting device of each light fixture module;

the light fixture modules independently mounted to the elongate light fixture base, extending perpendicularly from opposing sides of the elongate light fixture base, and forming a cooling channel between the light fixture module and the elongate light fixture base, the open faces of the light fixture modules facing a common direction to produce an initial light distribution pattern;

each of the light fixture modules having a housing adjustment feature for independently pivoting the respective light fixture module about a pivot axis parallel to the longitudinal axis to modify the initial light distribution pattern; and wherein the cooling fin height adjacent the elongate light fixture base is greater than the cooling fin height away from the elongate light fixture base.

2. The modular light fixture of claim 1, wherein the housing adjustment feature of each of the light fixture modules includes a swivel mount.

3. The modular light fixture of claim 1, wherein an attached end of each light fixture module is mounted to the elongate light fixture base at the housing adjustment feature, wherein each light fixture module includes a free end opposite the attached end.

4. The modular light fixture of claim 3, wherein the modular light fixture includes a first adjusted configuration in which the free end of each light fixture module is pivoted upward to produce an adjusted light distribution pattern that is wider than the initial light distribution pattern.

5. The modular light fixture of claim 4, wherein the housing adjustment feature of each light fixture module limits the angular range of motion of the free end to less than about 20 degrees.

6. The modular light fixture of claim 5, wherein the free end of each light fixture module is infinitely adjustable through the angular range of motion.

7. The modular light fixture of claim 1, wherein the elongate light fixture base has a first fixed length sized to support a first pair of light fixture modules.

8. The modular light fixture of claim 7, wherein the light fixture modules in the first pair are positioned on opposite sides of the elongate light fixture base at a common position along the longitudinal axis.

9. The modular light fixture of claim 1, wherein the elongate light fixture base has a second fixed length sized to support first and second pairs of light fixture modules.

10. The modular light fixture of claim 9, wherein the light fixture modules in each of the first and second pairs are positioned on opposite sides of the elongate light fixture base at a common position along the longitudinal axis.

11. The modular light fixture of claim 1, wherein the elongate light fixture base has a third fixed length sized to support first, second, and third pairs of light fixture modules.

12. The modular light fixture of claim 11, wherein the light fixture modules in each of the first, second, and third pairs are positioned on opposite sides of the elongate light fixture base at a common position along the longitudinal axis.

13. The modular light fixture of claim 1, wherein the light emitting device driver is housed within the elongate light fixture base.

14. The modular light fixture of claim 1, further including an electrical junction box supported on the elongate light fixture base.

15. The modular light fixture of claim 1, wherein the open face of the housing of each of the light fixture modules includes a lens.

16. The modular light fixture of claim 1, wherein each of the plurality of cooling fins spans an entirety of the back side of the housing.

17. The modular light fixture of claim 1, wherein the light emitting device includes a plurality of individual emitters arranged in a planar array.

18. The modular light fixture of claim 1, wherein the modular light fixture includes a planar configuration in which the housings of the light fixture modules are oriented along a common plane.

19. A modular light fixture system, comprising:

an elongate light fixture base selected from a plurality of light fixture bases, wherein each of the plurality of light fixture bases houses a light emitting device driver and has a different length to support one or more pairs of light fixture modules;

wherein the one or more pairs of light fixture modules are selected from a plurality of interchangeable light fixture modules, wherein each of the interchangeable light fixture modules includes a housing having an open face, a light emitting device positioned inside the housing, and a plurality of cooling fins located on the housing opposite to the open face, wherein each of the cooling fins defines a cooling fin height which is greater adjacent to the light fixture base than away from the light fixture base; and an assembled configuration in which each module of the one or more pairs of light fixture modules is independently mounted to the elongate light fixture base using a housing adjustment feature, wherein the individual light fixture modules include an airflow passage defined by a space between the light fixture module and the elongate light fixture base, and wherein the housing adjustment feature permits pivotable movement of the module relative to the elongate light fixture base.

20. The modular light fixture of claim 19, wherein, in the assembled configuration, the modular light fixture system includes a planar configuration in which the housings of the light fixture modules are oriented along a common plane.

* * * * *